United States Patent [19]

Mitchell et al.

[11] Patent Number: 4,606,140

[45] Date of Patent: Aug. 19, 1986

[54] PAINTING PROTECTION VISOR

[76] Inventors: Sheila R. Mitchell, 1185 Merritt Ct., Shakopee, Minn. 55379; Phyllis A. Urbach, 4211 Grainwood Cir., N.E., Prior Lake, Minn. 55372

[21] Appl. No.: 574,746

[22] Filed: Jan. 30, 1984

[51] Int. Cl.[4] ..... G09F 1/12

[52] U.S. Cl. ..... 40/157; 40/10 R; 40/152.1

[58] Field of Search ..... 40/155, 157, 152, 152.1, 40/10 R, 16, 16.4

[56] References Cited

U.S. PATENT DOCUMENTS

| | | | |
|---|---|---|---|
| 467,700 | 1/1892 | Levy | 40/157 |
| 836,010 | 11/1906 | Brown | 40/157 |
| 3,665,628 | 5/1972 | Dammond | 40/155 |
| 3,965,601 | 6/1976 | Nielsen | 40/155 |
| 4,157,624 | 6/1979 | Sobel | 40/152.1 |
| 4,187,630 | 2/1980 | Giulie et al. | 40/155 |
| 4,420,138 | 12/1983 | Sobel | 40/152 |
| 4,475,296 | 10/1984 | Fremstad | 40/152 |

*Primary Examiner*—Gene Mancene
*Assistant Examiner*—Wenceslao J. Contreras
*Attorney, Agent, or Firm*—Paul L. Sjoquist

[57] ABSTRACT

A visor device for spacing a temporary protective cover over a painting canvas mounted on a rear frame of perimeter members. The visor device consists of a unitary semi-rigid strip of organic plastics material of uniform cross-sectional contour having a clip portion and a visor portion extending from the clip portion. The clip portion is removably fastenable to a rear frame perimeter member in a manner such that only the visor portion projects forwardly and in spaced relationship over edge areas of the front surface of the painting canvas. The composite assembly of a painting canvas with the visor device fastened to perimeter members and a protective cover fastened over two or more visor portions provides complete protection for a painting transported while the painting is undergoing drying.

3 Claims, 3 Drawing Figures

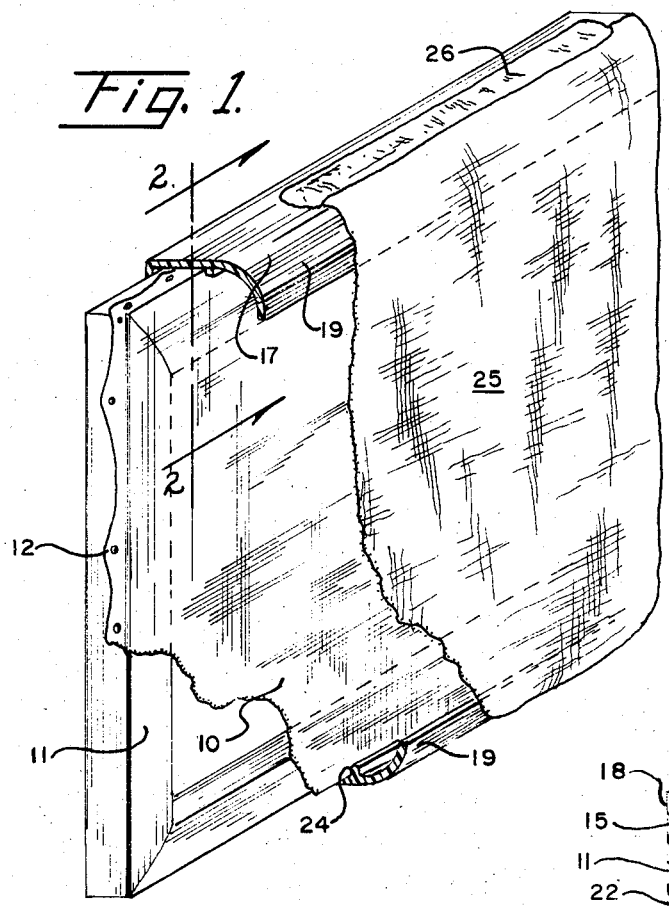
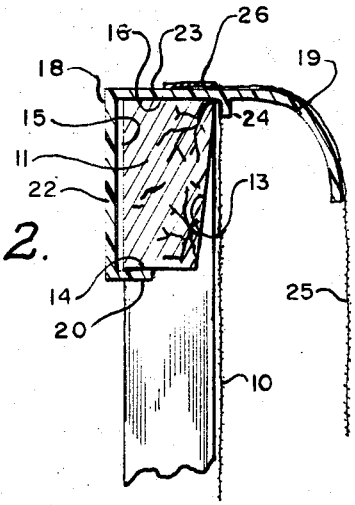
Fig. 2.
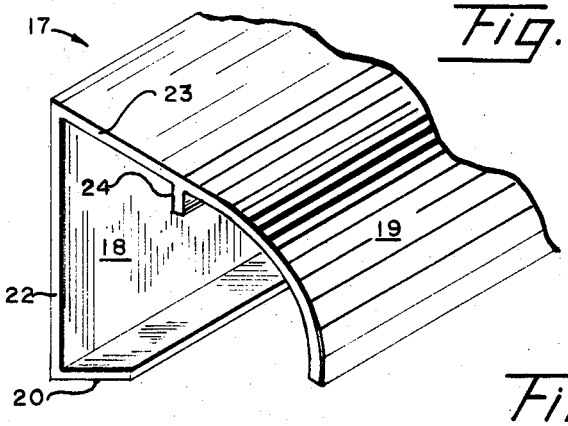
Fig. 3.

PAINTING PROTECTION VISOR

BACKGROUND OF THE INVENTION

This invention relates to a painting protection visor, and more particularly to a reusable visor device for spacing a temporary protective cover over a painting canvas which is mounted on a rear frame of perimeter members. The invention also relates to the assembly of a painting canvas and the visor means, as well as to that assembly plus a temporary protective cover.

Artists frequently encounter difficulty in protecting their oil paintings on canvas during the drying period, which can be extremely long, even up to several months. During this time, care must be taken to prevent smudging of the painting as well as other damage to it. The painting's surface should be shielded from contact with dirt or other objects, particularly during times the painting is transported or moved about. Ideally, even air dust should be shielded from the surface of the painting during the drying period.

Some artists have found it expedient to position painting canvases in spaced face-to-face relationship while carrying them about; but this approach is fraught with the danger that one surface of a painting will accidentally contact and smudge the other while placing the canvases in the spaced relationship. Lightly draping a cloth over a fresh canvas can also result in damage. Insofar as is known, all past approaches for protecting fresh paintings during transport of them have been bulky or inconvenient or fraught with hazard.

SUMMARY OF THE INVENTION

This invention provides a reusable visor device for spacing a temporary protective cover over a painting canvas mounted on a rear frame of perimeter members. The visor device consists essentially of a unitary semi-rigid strip of organic plastics material of uniform cross-sectional contour throughout. The cross-sectional contour is characterized by having a clip portion and a visor portion extending from the clip portion. The clip portion is removably fastenable or clippable to a rear frame perimeter member on which the canvas is mounted. The fastening of the clip portion to a rear frame perimeter member is such that only the visor portion projects forwardly and in spaced relationship over edge areas of the front surface of the canvas. The cross-sectional contour of the visor portion is preferably curved. The clip portion is preferably so designed that it effectively grips a rear frame perimeter member without in fact making contact with any significant portion of the front surface of the painting canvas. Preferably, the outside section of the clip portion is provided with an inwardly projecting ridge for abutment against the outer forward edge of a perimeter member. The ridge contributes to the maintenance of a clamping relationship of the clip portion to a perimeter member.

The assembly also provides a painting canvas mounted on a rear frame of perimeter members and visor means removably affixed exclusively to the perimeter members and having a visor portion projecting over edge areas of the front surface of the painting canvas in spaced relationship thereto. Further contemplated is the application of a gauze or other flexible sheet or cover material in spaced relationship over the entire front surface of the painting in spaced relationship and fixed at its edges to the visor portion of the visor device.

BRIEF DESCRIPTION OF THE DRAWING

FIG. 1 is a schematic perspective view, partially broken away, illustrating a complete assembly of the invention including the flexible temporary protective sheet cover in spaced relationship over the front surface of a painting;

FIG. 2 is a cross-sectional view, partially broken away, taken on line 2—2 of FIG. 1; and FIG. 3 is a schematic perspective view of the visor device of the invention.

DESCRIPTION OF THE PREFERRED EMBODIMENT

Referring to the drawing, particularly FIG. 1, the structure illustrated is that of a painting canvas 10 mounted on a frame of perimeter members 11. The perimeter members are normally wood members; and the canvas is fixed thereto by tacks 12 or other fasteners along the outer side of the perimeter members. Each perimeter member will be noted to have (see FIG. 2) an inner face surface 13 which lies proximately beneath the plane of the canvas 10, an inner side 14 disposed in a plane intersecting the plane of the canvas, a rear side 15 lying substantially parallel to the plane of the canvas, and an outer side 16 disposed in a plane intersecting the plane of the canvas and to which the edges of the canvas are affixed. Frequently the inner face surface 13 of perimeter frames is beveled so that the width of the inner side 14 is less than the width of the outer side 16 of the perimeter frame, whereby the canvas mounted on the frame is somewhat free from contact with the inner face surface 13 of perimeter members.

The visor device of the invention consists essentially of a unitary semi-rigid strip 17 of organic plastics material having a uniform cross-sectional contour throughout. This cross-sectional contour for the visor device is characterized by having a clip portion 18 and a visor portion 19 extending from the clip portion for projecting over edge areas of the front surface of the canvas 10 in spaced relationship thereto. The visor portion 19 is curved in its cross-sectional contour.

The clip portion itself has a special cross-sectional contour made up of sections (as looked upon in cross-section) which cooperate with one another to provide a clipping action to frame perimeter members without in fact requiring any substantial contact with the front surface of a painting canvas. Specifically, this cross-sectional contour is made up of a clamp section 20 for clamping against the inner side 14 of the perimeter frame, a rear section 22 for extending along the rear side 15 of a perimeter member, and an outside section 23 for extending along the outer side 16 of a perimeter member. The outer section 23 which extends along the outer side 16 of a perimeter member is approximately the same in distance or width as the outer side of the perimeter member, and may be provided with an internally projecting ridge or lip 24. This ridge or lip is for abutment against the outer side of a perimeter member and the extreme edge of the painting canvas to contribute to the maintenance of the clamping force between the canvas and perimeter member. The ridge 24 or lip projection contributes to the clip effect for the entire contour of the clip portion of the composite visor device. It will be noted that the ridge 24 preferably is in direct alignment along the forward edge of the perimeter member and canvas. It functions to apply pressure against the outer side of the perimeter member and thereby maintain the clamp section at its insert location. Additionally, the abutment of the ridge against the outer and forward side of the perimeter member functions as a frictional engagement to that edge, and the clamping effect is created by the combination of clamp section 20, rear section 22, outer section 23 and ridge 24 forming clip portion 18.

To be emphasized is that the composite visor device is easily clipped to the rear frame perimeter members without any danger whatsoever of contacting the front surface of the painting canvas.

Preferably, polyvinyl chloride is employed as the organic plastics material out of which the composite visor device is made. Extrusion is suitably employed. However, other organic plastics material may be employed, if desired. For example, polystyrene, polyethylene, or even other organic plastics may be employed, provided the selection is directed to materials which possess sufficient semi-rigidity so as to maintain their shape and perform a clipping function as well as exhibit sufficient yieldability in the nature of some resiliency so as to be distortable sufficiently for engagement of perimeter members in the manner described. Thus, the use of the term "semi-rigid" is intended to convey sufficient stiffness to serve as a structural element but sufficient resiliency or flexibility to allow for some distortion of shape and recovery from a distorted condition. Even rubbery type organic plastics fall within this category of organic plastics as the term is employed herein, provided the same have sufficient rigidity to maintain their structural shape for the purposes described.

After temporarily affixing the visor device in clip relationship to some or all of the perimeter frame members, a protective covering 25 may be affixed in a spaced relationship over the entire front surface of the painting by applying adhesive tape 26 to edges of the covering to hold it upon the outer visor device.

A complete assembly provides entirely adequate and effective protection for an oil painting during the time it is transported while drying.

Most particularly, the teaching of the invention provides an extremely simple and economical assembly to protect drying paintings. If desired, the protective covering may consist of a film of organic plastics material, preferably flexible but optionally even somewhat rigid. Ideally, however, gauze or similar material pervious to some air movement is employed.

It will be appreciated that some variations may be made in the illustrated cross-sectional contour of the visor device of the invention without departing from the essential structural principles of the invention as taught herein. In this regard, equivalents known or developed hereafter may be employed for various detailed features of the invention without departing from the essence thereof; and the claims appended hereto and made a part of this specfication should properly be constructed as broadly as consistent with their validity.

What is claimed is:

1. The assembly of a painting canvas mounted on a frame of perimeter members and visor means for spacing a temporary protective cover over said painting canvas, wherein each said perimeter member has an inner face surface lying proximately beneath the plane of the canvas, an inner side disposed in a plane intersecting the plane of the canvas, a rear side lying substantially parallel to the plane of the canvas, and an outer side disposed in a plane intersecting the plane of the canvas, said visor means consisting essentially of semi-rigid organic plastics strips of uniform cross-sectional contour, said cross-sectional contour being characterized by a clip portion comprising a clamp section inserted against said inner side of said perimeter member, a rear section extending along the rear side of said perimeter member, and an outside section extending along the outer side of said perimeter member, and a visor portion projecting forwardly from said outer section as a curved continuation thereof and oriented in spaced relationship over edge areas of the front surface of said canvas.

2. The assembly of claim 1, wherein said outside section of said clip portion includes a ridge projecting inwardly and abutting against the outer side of said perimeter member.

3. The assembly of claim 1, additionally comprising a flexible protective cover temperarily affixed to said visor portion and extending over said canvas.

* * * * *